United States Patent [19]

Tabakov et al.

[11] 4,368,920

[45] Jan. 18, 1983

[54] METHOD OF THERMAL-MINE WORKING OF OIL RESERVOIR

[76] Inventors: Vladimir P. Tabakov, ulitsa Sofii Kovalevskoi, 4a, kv. 125, Moscow; Alexandr I. Obrezkov, poselok Yarega, ulitsa Neftyanikov, 1, kv. 14, Komi ASSR, Ukhta, both of U.S.S.R.

[21] Appl. No.: 179,978

[22] Filed: Aug. 21, 1980

[51] Int. Cl.[3] ..... E21C 41/10

[52] U.S. Cl. ..... 299/2; 166/50

[58] Field of Search ..... 299/2; 166/50

[56] References Cited

U.S. PATENT DOCUMENTS

| | | | |
|---|---|---|---|
| 2,481,051 | 9/1949 | Uren | 299/2 |
| 4,099,783 | 7/1978 | Verty | 166/50 |
| 4,201,420 | 5/1980 | Likholai | 166/50 |
| 4,227,743 | 10/1980 | Ruzin et al. | 299/2 |
| 4,283,088 | 8/1981 | Tabakov | 299/2 |

*Primary Examiner*—William F. Pate, III

*Attorney, Agent, or Firm*—Lilling & Greenspan

[57] ABSTRACT

The method of thermal-mine working of an oil reservoir includes providing at least one injection gallery and a recovery gallery and drilling therefrom, respectively, injection and recovery wells. The formation is heated up by feeding a heat carrier into the injection wells, and oil with associated water thus evolved is withdrawn through the recovery wells. The associated water is separated from the oil and pumped into the oil-bearing formation, to assist in driving-out the oil. The recovered oil is conveyed to the ground surface through the mine workings. At least one auxiliary well is also drilled, to connect directly the recovery gallery and the injection gallery; and, a pipe line is mounted in this auxiliary well and spaced from the walls of the bore of the auxiliary well. Oil and associated water are separated directly within the recovery gallery. The associated water thus obtained is conveyed via the pipe line to the injection gallery, to be fed into the injection wells, while at the same time oil and associated water are recovered through the annular space between the pipe line and the walls of the auxiliary well.

1 Claim, 2 Drawing Figures

METHOD OF THERMAL-MINE WORKING OF OIL RESERVOIR

FIELD OF THE INVENTION

The invention relates to rendering productive reservoirs or deposits of crude oil or petroleum (hereinafter referred to as "oil reservoirs"), and more particularly it relates to a thermal-mine or thermoshaft working method that can be employed in oil production.

The present invention can be utilized to utmost effectiveness in the working of reservoirs containing superviscous crude oil grades and mobile or fluid bitumens.

At present, such reservoirs cannot be generally rendered productive by the conventional technique of producing oil through wells drilled from the earth surface, on account of the oil yield being inadequate.

DESCRIPTION OF THE PRIOR ART

For working an oil field containing superviscous oil and fluid bitumens there is used a well-known mine method of producing oil without bringing the oil-saturated rock to the ground surface (cf. "Mine Working of Oil Reservoirs" by A. Y. Krems et al., in Russian, GOSTOPTECHIZDAT Publishers, Moscow, 1955, p. 274).

This known method includes providing a system of mine openings or workings above the roof of the oil-bearing formation, the system including field drifts with drilling chambers. Inclined and vertical holes or wells are drilled from the drilling chambers, through which wells oil is produced, once the wells have been drilled, by the wild flow technique and then by air-lift. With the wild flow technique, the oil rises from the oil-bearing formation through the wells into the drilling chambers, owing to the formation pressure. With the air-lift technique, the oil is raised from the oil-bearing formation via the wells into the drilling chamber by pumping-in compressed air through pipes mounted in the wells.

The oil with the associated water issuing from the formation is conveyed to plants where the oil is separated from the main water body, from which plants the oil is pumped into central underground collectors. Then, following the primary treatment and heating-up, the oil is pumped into tanks on the ground surface. The associated water is also pumped to the ground surface, with but a portion of it being used within the mine as the flushing fluid as well-drilling.

The abovedescribed known method enables, in accordance with the geological and physical parameters of the oil-bearing formation and the oil properties, an optimized arrangement of the wells for working the reservoirs, providing for an increased yield.

However, although the oil yield of the reservoir is thus at least tripled in comparison with production through wells drilled from the ground surface, the absolute value of the attained yield would not be, as a rule, higher than 10% in case of formations bearing superviscous oil, averaging about 6%.

This low yield has brought about the desirability of resorting to methods of working an oil reservoir based on exerting a physical action upon the formation and the oil saturating it.

There is known a thermal-mine or thermoshaft method of producing oil by exerting a steam-heat action upon the formation (cf. "Experience of Using Heat Methods at Mine Working of Reservoirs With Superviscous Oils" by V. N. Mishakov et al., in Russian, "Neftyanoye Khozyaistvo" Magazine, No. 10, 1974, pp. 31–35).

The method includes providing a set of mine workings overlying the oil-bearing formation, including mine shafts, shaft-adjoining workings, drifts and drilling chambers. Vertical and inclined injection and recovery holes or wells are drilled from the drill chambers accommodated in the drifts. A heat carrier, e.g. steam, is fed through the injection wells into the oil-bearing formation, to drive the oil from the injection wells toward the recovery wells. From the hole bottom of the recovery wells the oil and associated water are raised into the drill chambers by the air-lift technique.

A disadvantage of the method results from considerable heat losses with the associated water which is pumped to the ground surface upon having the oil separated therefrom.

There is also known a method of mine working of an oil reservoir (cf. SU Inventor's Certificate No. 567,356; Int.Cl. E 21 b 43/24, 1974) wherein the heat carrier is introduced through pipes extending to the bottoms of the well bores, while oil is withdrawn through the same wells, with the heat carrier being fed into the annulus with pre-throttling of its flow, while the slurry (oil, hot water and sand) is pumped from the drill chamber through either specifically provided wells or the mine workings to the ground surface where it is separated into its components. The hot water separated from the pulp is injected into the formation through other specifically provided injection chambers, for the water to yield its heat within the formation and to assist in driving the oil from the heated areas toward the recovery wells.

A disadvantage of this method is the impaired efficiency of the thermal action upon the formation by the injected hot water, since the latter significantly cools down while being raised to the ground surface, separated from the slurry and pumped back into the oil-bearing formation.

There is also known a method of thermal-mine or thermoshaft production of oil (cf. U.S. Pat. No. 4,099,783), according to which a producing formation is heated by intermittent feed of steam from mine workings overlying the recovery gallery, through a system of injection holes or wells.

Without interrupting the steam injection, the fluid (i.e. oil and water) is intermittently withdrawn through recovery wells drilled from a recovery gallery provided in the lower portion of the formation, whereafter hot water is intermittently injected, while continuing the withdrawal of the fluid through the wells of the recovery gallery.

While implementing this method, the associated water can be utilized for injection into the oil-bearing formation at a later stage of the working cycle, with oil with the associated water being pumped from the recovery gallery via pipes laid in an inclined mine working and in above-formation mine workings toward plants where the associated water is separated from oil, whereafter the associated water is fed into the injection gallery, toward the heads of the injection wells.

A disadvantage of this method which, is considered the closest prior art of the present invention, is a relatively low yield of oil, on account of the impaired efficiency of the heat action of the injected associated water which wastes a considerable amount of its heat while being pumped through the lengthy pipelines extending through the mine workings. Besides, the temperature within the mine workings themselves is raised, which impairs the working environment of the personnel. Should heat insulation of the water lines be resorted to, the cost of the process of thermal-mine working of the oil-bearing formation would be significantly increased.

SUMMARY OF THE INVENTION

It is the main object of the present invention to provide a method of thermal-mine working of an oil reservoir, which should enable an increase in the oil yield of an oil-bearing formation in comparison with other hitherto known similar methods of oil production.

It is another object of the invention to provide a method of thermal-mine working of an oil reservoir, which should enhance the efficiency of the process of heating up an oil-bearing formation.

It is still another object of the present invention to create a method of thermal-mine working of an oil reservoir, which should enable an increase of the recovery of superviscous oil from a well.

These and other objects are attained by a method of thermal-mine working of an oil reservoir, including:

providing a set of undergound mine workings including at least one injection gallery and a recovery gallery;

drilling injection wells into the oil-bearing formation from the injection gallery and drilling recovery wells into the formation from the recovery gallery;

drilling at least one auxiliary well directly connecting the recovery gallery and the injection gallery through the oil-bearing fromation;

mounting in said auxiliary well a pipe spaced from the walls of said auxiliary well;

positively feeding a heat carrier into the oil-bearing formation through the injection wells, to heat up the formation to a temperature at which the oil in the oil-bearing formation attains a required fluidity;

withdrawing oil with associated water from the oil-bearing formation through the recovery wells into the recovery gallery;

effecting separation of the oil and associated water directly within the recovery gallery;

conveying thus obtained associated water via the pipe line in the auxiliary well to the injection gallery, to feed this water through the injection wells into the oil-bearing formation;

withdrawing simultaneously oil and associated water issuing from the oil-bearing formation adjoining the auxiliary well into the recovery gallery, through the space between the pipe line extending in the auxiliary well and the walls of the auxiliary well; and conveying oil separated from associated water from the recovery well through the mine workings to the ground surface.

In the herein disclosed method, the improvement in accordance with the invention is that at least one auxiliary well is drilled to connect the recovery and injection galleries directly through the oil-bearing formation, a pipe line is mounted in this auxiliary well, spaced from the walls thereof, the oil and associated water are separated directly within the recovery gallery, and the associated water thus obtained is conveyed via the pipe line in the auxiliary well toward the injection gallery, to be subsequently fed into the injection wells. Simultaneously the oil and associated water issuing from the oil-bearing formation adjoining the auxiliary well are withdrawn into the recovery gallery through the space between the pipe line in the auxiliary well and the walls thereof.

The increased oil yield is attained, owing to the heating-up of the oil-bearing formation and of the oil saturating it by the injected heat carrier, e.g. steam, and, hence, primarily owing to the reduced viscosity of the oil.

The increased oil yield is also attained, owing to the increased oil-driving factor, with the associated formation water being pumped into the heated oil-bearing formation through some of the injection wells. For this purpose there is drilled at least one auxiliary well directly connecting the recovery and injection galleries through the oil-bearing formation, a pipe line is mounted in this auxiliary well, spaced from the walls of the wellbore, the oil and associated water are separated directly in the recovery gallery, and the associated water thus obtained is conveyed via the pipe line extending in the auxiliary well to the injection gallery, to be fed into the injection wells.

The increased efficiency of the process of heating the formation is attained, owing to the withdrawal of oil with associated water being conducted through the auxiliary well from the oil-bearing formation adjoining this well into the recovery gallery, through the space between the pipe line extending through the auxiliary well and the walls thereof.

The increased yield of superviscous oil from the auxiliary recovery well is attained, owing to the walls of this well and the formation area adjoining this well being additionally heated as the hot associated water is being pumped though the pipe line, whereby the well is cleaned from wax, resins, etc., i.e. the oil permeability of the formation is increased, while the oil viscosity is reduced.

BRIEF DESCRIPTION OF THE INVENTION

The present invention will be further described in connection with an embodiment thereof, with reference being had to the accompanying drawings, wherein:

FIG. 1 schematically illustrates an oil recovery mine with the major mine workings and wells; and FIG. 2 is a vertical section of the oil-bearing formation through the auxiliary well directly connecting the recovery and injection galleries through the oil-bearing formation.

DETAILED DESCRIPTION OF THE INVENTION

Figure 1:
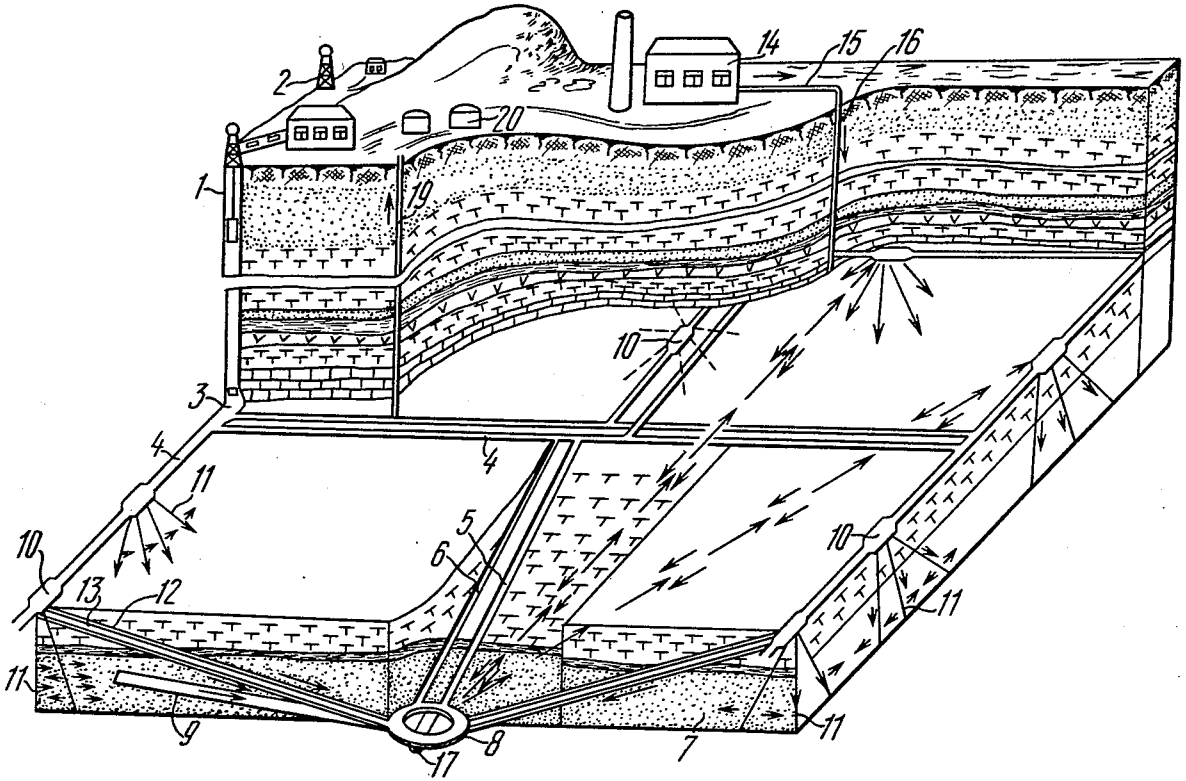

The herein disclosed method is carried out as follows.

In an oil reservoir there is provided a system of mine workings including two mine shafts, viz. a hoisting shaft 1 (FIG. 1) and a ventilating or air shaft 2, a mine yard 3, shaft bottom workings (not shown) accommodating an electric mine locomotive yard, pumping stations, stores, etc. (not shown, either), drifts 4, inclined mine workings 5 and 6. The drifts 4 are provided above the roof of the oil-bearing formation 7. They are inclined at 1° to 3° to a horizontal plane. However, the essence of the invention would not alter if the drifts 4 were provided under the roof of the oil-bearing formation 7.

The inclined mine workings 5 and 6 are driven from the drifts 4 into the area of the oil-bearing formation 7, where at least one recovery gallery 8 is provided.

The recovery gallery 8 may have various shapes, e.g. a circular one (as shown in FIG. 1), elliptical, rectilinear, square or any other, depending on the shape of the area of the development of the mine field, which area, in its turn, may be shaped as a regular polygon, e.g. a hexagon, a square, or otherwise.

Figure 2:
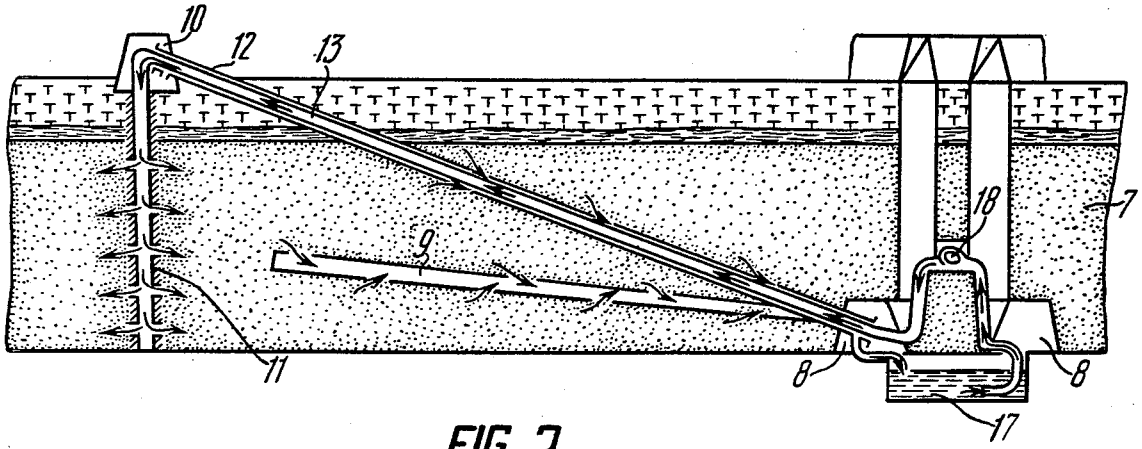

From the recovery gallery 8 there are drilled recovery wells 9 (FIGS. 1 and 2). With a circular recovery gallery 8, these wells are drilled at uniform angular spacing along the radii of the circle, as shown in FIG. 1. In case of a rectilinear recovery gallery 8, the recovery wells 9 are drilled at uniform spacing throughout the mining area to extend parallel with one another.

At least one injection gallery 10 is provided either above or below the oil-bearing formation, or else directly within the oil-bearing formation. Injection wells 11 are drilled from the injection gallery 10.

Either from the injection gallery 10 or from the recovery one 8 there is drilled at least gallery auxiliary well 12 connecting the injection and recovery galleries 10 and 8, respectively, directly through the oil-bearing formation 7. In this auxiliary well 12 there is mounted a pipe line 13 spaced from the walls of the auxiliary well 12.

A heat carrier, e.g. steam, is supplied to the heads of the injection wells 11 from a boiler plant 14 (FIG. 1) via an above-ground pipe line 15, a steam supply well 16 and underground steam lines (not shown) laid in the corresponding drifts 4.

By injecting steam through the system of the injection wells 11, the oil-bearing formation 7 is heated up to a temperature at which the oil attains the required fluidity. This temperature may vary within a broad range for different oil reservoirs, from about 80° to 250° C., depending on the properties of the crude.

Owing to the dense network of the injection wells 11 having a considerable length within the oil-bearing formation, the formation can be heated up uniformly and quickly throughout its volume. This is attained by arranging the injection wells 11 into a dense grid, and, in cases where the injection gallery extends either within the oil-bearing formation 7 or close to it, horizontal, gently descending and ascending injection wells 11 are made to extend through the oil-bearing formation 7 by dozens and hundreds of meters, interconnecting its non-uniform zones and various channels, cracks, fissures, caverns, and thus enhancing the degree of opening-up of the oil-bearing formation 7.

With the temperature of the oil-bearing formation rising, the viscosity of the oil decreases, and its fluidity increases.

Oil with associated water is withdrawn through the recovery wells 9 into the recovery gallery 10. As experience of thermal-mine oil recovery shows, the water content of the recovered oil-water mixture can be high—as high as 80 per cent and even higher. The associated water is at a high temperature which varies from one well to another, but averages about 60° C. for the entire recovery gallery for the first year or two of the production, and 80° C. and higher for the third and fourth years.

Some of this water is spent on conveying the superviscous oil, since the mine recovery method is predominantly used for developing oil reservoirs with oil of the superviscous type. About 20% of the associated water is used on this task.

In the hitherto known methods a small portion of the associated water is injected into the oil-bearing formation, whereas its major portion is pumped to the gound surface. However, the associated water pumped to the surface carries therewith a substantial amount of heat which is wasted.

When the associated water is injected into the oil-bearing formation in accordance with the hitherto known methods, the heat losses along the conveying pipe lines are so high that it is practically cool water which comes to the heads of the injection wells. At an earlier development stage the injection of tepid water would not be of any use, since it entails the reduction of the fluidity of oil in the formation, and, hence, impaired oil yield.

According to the herein disclosed method, oil and associated water are separated directly within the recovery gallery (FIG. 2) in a special-design tank 17, and the hot associated water thus obtained is conveyed by means of a pump 18 via the pipe line 13 in the auxiliary well 12 to the injection gallery 10, for feeding this water into the injection wells 11.

By supplying the obtained associated hot water from the recovery gallery 8 to the injection wells 11 via the pipe line 13 in the auxiliary well 12, while at the same time withdrawing oil with associated water from the oil-bearing formation 7 adjoining the auxiliary well 12 into the recovery gallery via the space between the pipe line 13 within the auxiliary well 12 and the walls thereof, the three major goals are attained.

Firstly, the bores and bottoms of the auxiliary recovery wells 12 are uniformly heated throughout their length and are maintained in this state through the entire time of feeding the associated hot water.

Secondly, the hot water would not decrease its temperature, and in some cases would even raise it. Owing to this, the heat is more uniformly distributed within the oil-bearing formation 7, which enhances the process of driving oil from the formation 7.

Thirdly, the heat losses are substantially reduced, as compared with the hitherto known methods wherein these losses are incurred by the water being pumped from a recovery gallery 8 toward an above-formation level via specific pipe lines extending through inclined mine working 5 (FIG. 1) and 6, toward specific plants (not shown) separating the associated water from oil, and only then being fed via pipe lines accommodated in drifts 4 toward the injection galleries 10, to the heads of the injection wells 11.

With hot water being injected instead of cool one, the oil-drive characteristics, e.g. the drive factor and the drive sweep factor are enhanced, while the specific steam consumption is reduced, whereby not only is the oil yield stepped up, but the efficiency of the heat action is improved as well.

The oil and associated water flowing into the recovery gallery 8 through the recovery wells 9 carry therealong some amount of sand. The sand coming in with the fluid is separated from the fluid in a specifically provided settling tank 17 (FIG. 2). The oil with some content of associated water is pumped into the central oil trap, i.e. the plant for separating oil from water, and then is pumped via a specifically provided well 19 (FIG. 1) into oil tanks 20 on the ground surface, while the hot associated water, as it has been already described, is pumped by a pump 18 (FIG. 2) via the pipe line 13 within the auxiliary well 12 to the injection gallery, and then to the heads of the injection wells 11, while simultaneously recovering oil with associated water from the oil-bearing formation 7 via the annular space between the walls of the auxiliary well 12 and the external surface of the pipe line 13. The respective flows of the hot water through the central pipes 13 and of the fluid being recovered via the annular space in the well 12 are oppositely directed.

The hot water heats up the bore-adjoining area about the auxiliary well 12 throughout the auxiliary well's entire length. Owing to this, the walls of the auxiliary well 12 are additionally cleaned from asphalt and pitch deposits, the degree of the opening-up of the oil-bearing formation is stepped up, and the yield of the wells is increased.

The hot water enters the oil-bearing formation 7 without becoming substantially cooled down, which enhances the drive and drive sweep factors and thus increases the oil yield of the formation and improves the efficiency of the heat action.

Under real production conditions, the method is implemented as a sequence of the following operations.

1. There is provided a system of underground mine workings, including mine shafts 1 and 2 (FIG. 1), shaft bottom workings 3 and major drifts 4.

2. A recovery gallery 8 is provided in the bottom portion of the oil-bearing formation 7, which is preferably of a circular shape. However, the essence of the invention remains the same if the recovery gallery 8 is rectilianear, in which case the recovery galleries are spaced by 450 to 550 m from one another.

3. Injection galleries are provided either 15 to 20 m above the oil-bearing formation, or within the formation itself.

4. Horizontal and ascending recovery wells 9 are drilled from the recovery gallery 8, while injection wells 11 are drilled from the injection gallery 11.

5. For each group of 25 to 30 recovery wells 9, there is drilled a single auxiliary well 12 which additionally opens up the oil-bearing formation 7 and directly connects the injection gallery 10 and the recovery gallery 8 through the formation 7.

6. A pipe line 13 is layed through the auxiliary well 12, connected in the injection gallery 10 with the heads of the injection wells 11 and in the recovery gallery 8 with the pump 18.

7. A heat carrier is injected through the injection wells under a 5 to 20 kgf/cm$^2$ pressure into the oil-bearing formation 7, to heat the formation to a temperature at which the oil attains the required fluidity.

Then all the injection wells 11 of the area being worked are broken up into groups, and within each group the heat carrier, i.e. steam is intermittently fed, with 15- to 30-day feeding periods alternating with idling periods of the same duration.

8. Oil with associated water is withdrawn from the oil-bearing formation 7 through the recovery wells 9 into the recovery gallery 8, and then into the settling tank 17.

9. Oil is separated from associated water directly in the recovery gallery 8, and the associated hot water thus obtained is conveyed via the pipe line 13 within the auxiliary well 12 to the injection gallery 10, to be fed through the injection wells 11 into the oil-bearing formation 7.

10. Simultaneously with pumping the hot water through the pipe line 13, oil and associated water are recovered into the recovery gallery 8 through the annular space of the well 12.

11. Following its separation from associated water in the settling tank 17, the oil is supplied into the central oil-collecting stations within the mine, wherefrom it is pumped either through a specifically provided well 19, or through a pipe line in the mine shaft into tanks 20 on the ground surface.

What we claim is:

1. A method of mine working an oil reservoir, comprising the steps of:

providing a set of underground mine workings including at least one injection gallery and a recovery gallery;

drilling injection wells into the oil-bearing formation from said injection gallery and drilling recovery wells into the formation from said recovery gallery;

drilling at least one auxiliary well directly connecting said recovery gallery and said injection gallery through the oil-bearing formation;

mounting in said auxiliary well a pipe line spaced from the walls of said auxiliary well;

positively feeding a heat carrier into the oil-bearing formation through said injection wells, to heat up the formation to a temperature at which the oil in the oil-bearing formation attains the required fluidity;

withdrawing oil with associated water from the oil-bearing formation into said recovery gallery through said recovery wells;

effecting separation of the oil and associated water directly within said recovery gallery;

conveying the thus obtained associated water via said pipe line in said auxiliary well to said injection gallery, to feed this water through said injection wells into the oil-bearing formation;

simultaneously recovering oil and associated water issuing from the formation adjoining said auxiliary well into said recovery gallery, through said space between said pipe line in said auxiliary well and the walls of said auxiliary well; and conveying oil separated from associated water from said recovery gallery through the mine workings to the ground surface.

* * * * *